US012188207B2

(12) United States Patent
Oglesby et al.

(10) Patent No.: US 12,188,207 B2
(45) Date of Patent: Jan. 7, 2025

(54) SYSTEM AND METHOD FOR TERRAIN BASED CONTROL OF SELF-PROPELLED WORK VEHICLES

(71) Applicant: Deere & Company, Moline, IL (US)

(72) Inventors: Madeline T. Oglesby, Asbury, IA (US); Dipankar D. Dongare, Dombivali (IN); Dnyaneshwar J. Jagtap, Dhule (IN); Rushikesh R. Jadhav, Parbhani (IN); Tejal Bhardwaj, Kharar (IN); Jeremiah Wickersheim, Dubuque, IA (US); Giovanni A. Wuisan, Epworth, IA (US); Todd F. Velde, Dubuque, IA (US)

(73) Assignee: Deere &Company, Moline, IL (US)

( * ) Notice: Subject to any disclaimer, the term of this patent is extended or adjusted under 35 U.S.C. 154(b) by 487 days.

(21) Appl. No.: 17/193,013

(22) Filed: Mar. 5, 2021

(65) Prior Publication Data

US 2022/0282460 A1 Sep. 8, 2022

(51) Int. Cl.

| | |
|---|---|
| ***E02F 9/26*** | (2006.01) |
| ***E02F 3/43*** | (2006.01) |
| ***E02F 9/20*** | (2006.01) |

(52) U.S. Cl.

CPC ..... *E02F 9/262* (2013.01); *E02F 3/439* (2013.01); *E02F 9/2087* (2013.01); *E02F 9/265* (2013.01)

(58) Field of Classification Search

CPC . E02F 9/262; E02F 9/264; E02F 9/265; E02F 9/2041; E02F 9/2045; E02F 3/439

See application file for complete search history.

(56) References Cited

U.S. PATENT DOCUMENTS 4,953,723 A * 9/1990 Saotome ..... B66C 13/066 91/437
6,305,763 B1 10/2001 Oertley
(Continued)

FOREIGN PATENT DOCUMENTS

CN 108331062 A * 7/2018 ..... E02F 9/2004
DE 102019202654 A1 8/2019
(Continued)

OTHER PUBLICATIONS

German Search Report issued in application No. DE102022200684.4 dated Oct. 27, 2022 (06 pages).

*Primary Examiner* — Russell Frejd
*Assistant Examiner* — Sara J Lewandroski
(74) *Attorney, Agent, or Firm* — Gary L. Montle; Lucian Wayne Beavers; Patterson Intellectual Property Law, PC

(57) ABSTRACT

A terrain-based travel assist system and method are provided for stability control in a self-propelled work vehicle such as an excavator comprising ground engaging units and at least one work implement configured for controllably working terrain. Upon selecting or determining a travel mode for the work vehicle, the respective predetermined target positions and/or operations of the at least one work implement are retrieved from data storage, corresponding to the determined travel mode. Feedback signals are received from sensors corresponding to respective current positions and/or operations of the at least one implement, and in some embodiments to a vehicle speed. Control signals are generated for automatically controlling the at least one work implement to the respective predetermined target positions and/or through the respective operations, responsive to the determined travel mode and the received feedback signals.

17 Claims, 5 Drawing Sheets

(56) References Cited

U.S. PATENT DOCUMENTS

| | | | | |
|---|---|---|---|---|
| 6,609,315 | B1 | 8/2003 | Hendron et al. | |
| 7,949,449 | B2 | 5/2011 | Koch et al. | |
| 11,577,796 | B2 | 2/2023 | Jagtap et al. | |
| 2005/0065689 | A1* | 3/2005 | Budde | E02F 3/845 701/50 |
| 2008/0262682 | A1 | 10/2008 | Bergsten | |
| 2015/0308078 | A1* | 10/2015 | Lee | F15B 13/085 60/368 |
| 2016/0153175 | A1* | 6/2016 | Wei | E02F 9/262 701/50 |
| 2017/0037593 | A1 | 2/2017 | Naik et al. | |
| 2017/0081826 | A1* | 3/2017 | Ferracin | E02F 9/2296 |
| 2019/0017248 | A1* | 1/2019 | Okada | E02F 9/20 |
| 2019/0264419 | A1 | 8/2019 | Myers et al. | |
| 2019/0285093 | A1 | 9/2019 | Muraoka et al. | |
| 2020/0063401 | A1* | 2/2020 | Sherlock | E02F 9/262 |
| 2021/0087794 | A1* | 3/2021 | Yamamoto | B60R 1/27 |

FOREIGN PATENT DOCUMENTS

| | | | | | |
|---|---|---|---|---|---|
| DE | 102019211246 | A1 | | 1/2020 | |
| EP | 2578757 | A1 | | 4/2013 | |
| EP | 3521520 | A1 | | 8/2019 | |
| EP | 3575501 | A1 | | 12/2019 | |
| JP | 2020051066 | A | * | 4/2020 | |
| KR | 10-2016-0144707 | | * | 12/2016 | |
| KR | 2016144707 | A | * | 12/2016 | E02F 9/2004 |
| WO | 2014166331 | A1 | | 10/2014 | |
| WO | 2018021321 | A1 | | 2/2018 | |

* cited by examiner

SYSTEM AND METHOD FOR TERRAIN BASED CONTROL OF SELF-PROPELLED WORK VEHICLES

FIELD OF THE DISCLOSURE

The present disclosure relates generally to self-propelled work vehicles such as construction and forestry machines, and more particularly to systems and methods for control of certain movements and/or operations of such self-propelled work vehicles based on, e.g., underlying terrain.

BACKGROUND

Self-propelled work vehicles of this type may for example include excavator machines, forestry machines, front shovel machines, and others. These machines may typically have tracked ground engaging units supporting the undercarriage from the ground surface.

Exemplary work vehicles according to the present disclosure further include attachments comprising work implements that are movable with respect to the work vehicle by various actuators in order to accomplish tasks with the implement. Discussion herein may typically focus on an excavator machine as an exemplary work vehicle, with the corresponding application of moving implements configured as a boom, an arm, a bucket, and the like (collectively a boom assembly), with actuators for moving the implements generally configured as hydraulic cylinders.

When self-propelled work vehicles such as for example excavators travel on slopes, a substantial amount of operator skill may conventionally be required. The operator of an excavator needs to control the associated boom, arm, and bucket positions simultaneously along with the travel direction of the vehicle. For example, if the excavator is travelling uphill the various elements may be positioned to support the excavator body in the climbing steps by executing a 'pull-up' action, with attachments initially extended outward and low to the ground. If the excavator is travelling downhill the various elements may be positioned to support the excavator body by executing a 'push-back' action, with the attachments again initially extended outward and low to the ground. In any given type of terrain including even flat terrain, the various elements of the work vehicle, particularly working attachments such as the boom, arm, bucket, etc., may be positioned in accordance with the type of terrain to stabilize the work vehicle orientation as a whole and substantially prevent roll-over conditions.

It would be desirable to reliably automate certain coordinated operations based on the type of terrain upon or across which the work vehicle is travelling, including for example ramps and flat surfaces, thereby increasing vehicle stability and further reducing operator fatigue and/or mitigating the impact of operator inexperience when otherwise manually operating a large number of simultaneous controls.

BRIEF SUMMARY

The current disclosure in various embodiments provides an enhancement to conventional systems, at least in part by introducing a novel system and method for monitoring work vehicle orientation, including the positioning of various attachments relative to the work vehicle frame based at least in part on kinematic feedback, and accordingly implementing automation of certain vehicle operations and associated functions during for example uphill and downhill travel of varying degree and/or distance, and travel across relatively flat terrain.

Relating for example to an excavator as the work vehicle, a system and method as disclosed may be configured to automatically control implements such as the arm, bucket, and boom attachments using kinematic feedback further in view of a selected and/or determined travel mode. In the context of a steep uphill grade, the operator may initially place the bucket teeth in a specified manner on the ground surface, and then provide a travel command to a work vehicle controller or equivalent device, whereupon the arm may be automatically retracted as per the rate of travel command. In other exemplary travel modes the boom, arm, and bucket may be positioned automatically in other predetermined positions and/or moved in accordance with predetermined sequences of operation.

In one embodiment, a computer-implemented method as disclosed herein is provided for stability control for a self-propelled work vehicle comprising a plurality of ground engaging units and at least one work implement configured for controllably working terrain. The exemplary disclosed method includes retrieving from data storage at least respective predetermined target positions and/or operations of the at least one work implement, corresponding to a determined travel mode for the self-propelled work vehicle, receiving feedback signals from one or more sensors corresponding to respective current positions and/or operations of the at least one implement, and generating one or more control signals for automatically controlling the at least one work implement to the respective predetermined target positions and/or through the respective operations, responsive to the determined travel mode and the received feedback signals.

In one exemplary aspect of the above-referenced embodiment, the travel mode may be determined in accordance with manual user selection from among a plurality of travel modes via a user interface.

In another exemplary aspect of the above-referenced embodiment, the method may further include receiving feedback signals corresponding to a predicted work vehicle grade from one or more sensors linked to a grade control unit, wherein the determined travel mode is confirmed via the predicted work vehicle grade.

In another exemplary aspect of the above-referenced embodiment, the method may further include receiving feedback signals corresponding to a predicted work vehicle grade from one or more sensors linked to a grade control unit, wherein the travel mode is determined in accordance with the predicted work vehicle grade.

In another exemplary aspect of the above-referenced embodiment, the method may further include receiving feedback signals corresponding to travel direction and/or speed commands for the self-propelled work vehicle during the determined travel mode.

The one or more control signals in accordance with at least the preceding aspect may optionally be generated for controlling the at least one work implement to the respective predetermined target positions and/or through the respective operations, responsive to the determined travel mode, the received feedback signals corresponding to respective current positions and/or operations of the at least one implement, and the received feedback signals corresponding to the travel commands.

The one or more control signals in accordance with at least the preceding aspect may optionally be generated for controlling the work vehicle speed during the determined travel mode, responsive to at least the predetermined target positions and/or operations of the at least one work implement and the received feedback signals corresponding to respective current positions and/or operations of the at least one implement.

For example, the work vehicle may be directed to stop during at least one required operation of the at least one implement during a determined travel mode, and to move forward only while the at least one implement is maintained in a predetermined position during the determined travel mode.

In another exemplary aspect of the above-referenced embodiment, the method may further include enabling manual dismissal of the automatic control during the determined travel mode via a user interface.

In another exemplary aspect of the above-referenced embodiment, the determined travel mode may correspond to a direction and/or amount of slope for terrain upon which the work vehicle travels.

In another embodiment, an inventive self-propelled work vehicle as disclosed herein may include a plurality of ground engaging units supporting a vehicle chassis, at least one work implement supported by the vehicle chassis and configured for controllably working terrain, one or more sensors configured to provide feedback signals corresponding to respective current positions and/or operations of the at least one implement, and data storage having stored therein at least respective predetermined target positions and/or operations of the at least one work implement corresponding to each of a plurality of travel modes for the self-propelled work vehicle. A controller associated with the work vehicle is further configured to direct the performance of operations corresponding to steps of the above-referenced method embodiment and optionally one or more of the above-referenced exemplary aspects thereof.

Numerous objects, features and advantages of the embodiments set forth herein will be readily apparent to those skilled in the art upon reading of the following disclosure when taken in conjunction with the accompanying drawings.

DETAILED DESCRIPTION

Referring now to FIGS. 1-4E, various embodiments may now be described of a system and method for providing, e.g., terrain-based travel assistance for self-propelled work vehicles. Briefly stated, an invention as disclosed herein may preferably identify travel modes and/or work states associated with multi-function and high precision coordinated movements, and enable automated features which simplify user operation and increase safety and reliability of the work vehicle.

Figure 1:
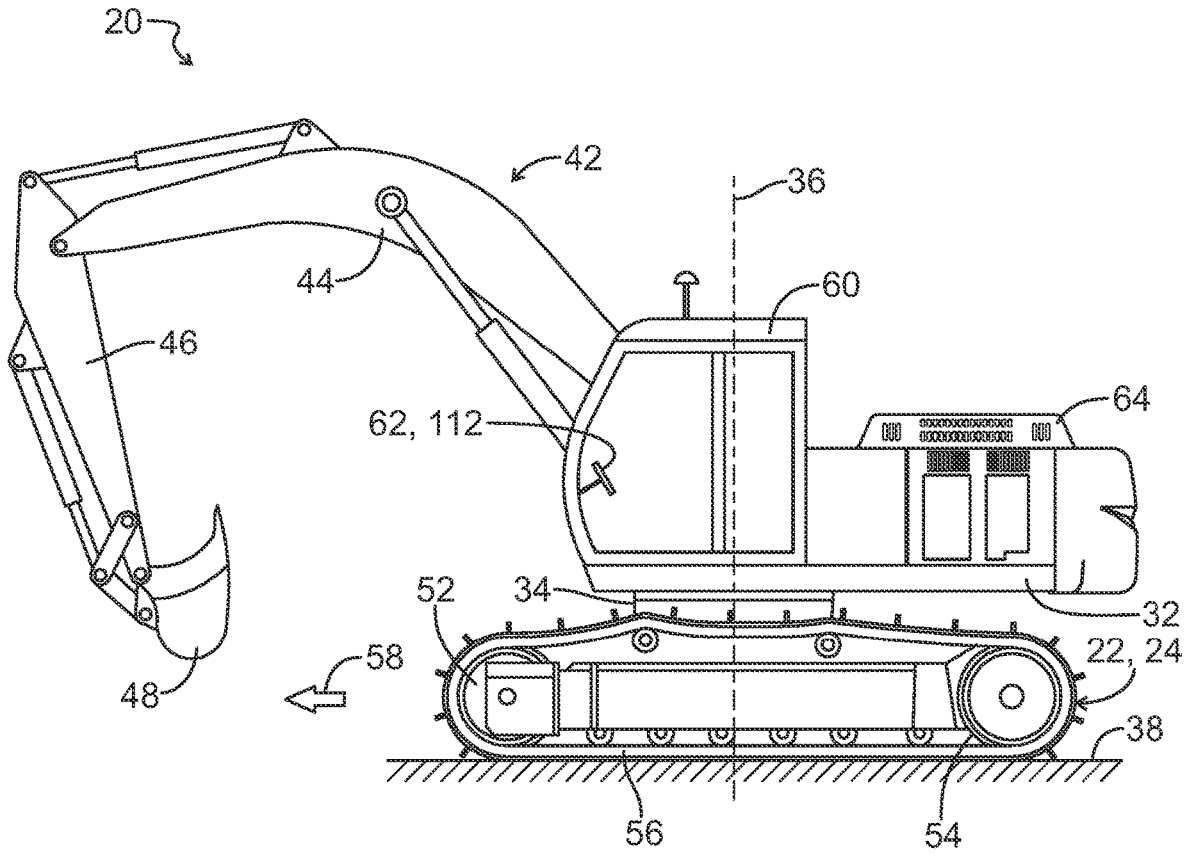
FIG. 1 is a side view representing an excavator as an exemplary self-propelled work vehicle according to the present disclosure.

FIG. 1 in a particular embodiment as disclosed herein shows a representative self-propelled work vehicle in the form of, for example, a tracked excavator machine 20. The work vehicle 20 includes an undercarriage 22 including first and second ground engaging units 24 including first and second travel motors (not shown) for driving the first and second ground engaging units 24, respectively.

A main frame 32 is supported from the undercarriage 22 by a swing bearing 34 such that the main frame 32 is pivotable about a pivot axis 36 relative to the undercarriage 22. The pivot axis 36 is substantially vertical when a ground surface 38 engaged by the ground engaging units 24 is substantially horizontal. A swing motor (not shown) is configured to pivot the main frame 32 on the swing bearing 34 about the pivot axis 36 relative to the undercarriage 22.

A work implement 42 in the context of the referenced work vehicle 20 includes a boom assembly 42 with a boom 44, an arm 46 pivotally connected to the boom 44, and a working tool 48. The term "implement" may be used herein to describe the boom assembly (or equivalent thereof) collectively, or individual elements of the boom assembly or equivalent thereof. The boom 44 is pivotally attached to the main frame 32 to pivot about a generally horizontal axis relative to the main frame 32. The working tool in this embodiment is an excavator shovel (or bucket) 48 which is pivotally connected to the arm 46. The boom assembly 42 extends from the main frame 32 along a working direction of the boom assembly 42. The working direction can also be described as a working direction of the boom 44. As described herein, control of the work implement 42 may relate to control of any one or more of the associated components (e.g., boom 44, arm 46, tool 48).

In the embodiment of FIG. 1, the first and second ground engaging units 24 are tracked ground engaging units, although various alternative embodiments of a work vehicle 20 are contemplated wherein the ground engaging units 24 may be wheeled ground engaging units. Each of the tracked ground engaging units 24 includes an idler 52, a drive sprocket 54, and a track chain 56 extending around the idler 52 and the drive sprocket 54. The travel motor of each tracked ground engaging unit 24 drives its respective drive sprocket 54. Each tracked ground engaging unit 24 is represented as having a forward traveling direction 58 defined from the drive sprocket 54 toward the idler 52. The forward traveling direction 58 of the tracked ground engaging units 24 also defines a forward traveling direction 58 of the undercarriage 22 and thus of the work vehicle 20. In some applications, including uphill travel as further discussed below, the orientation of the undercarriage 22 may be reversed such that a traveling direction of the work vehicle 20 is defined from the idler 52 toward its respective drive sprocket 54, whereas the work implement(s) 42 is still positioned ahead of the undercarriage 22 in the traveling direction.

An operator's cab 60 may be located on the main frame 32. The operator's cab 60 and the boom assembly 42 may both be mounted on the main frame 32 so that the operator's cab 60 faces in the working direction 58 of the boom assembly. A control station 62 may be located in the operator's cab 60.

Also mounted on the main frame 32 is an engine 64 for powering the work vehicle 20. The engine 64 may be a diesel internal combustion engine. The engine 64 may drive a hydraulic pump to provide hydraulic power to the various operating systems of the work vehicle 20.

Figure 2:
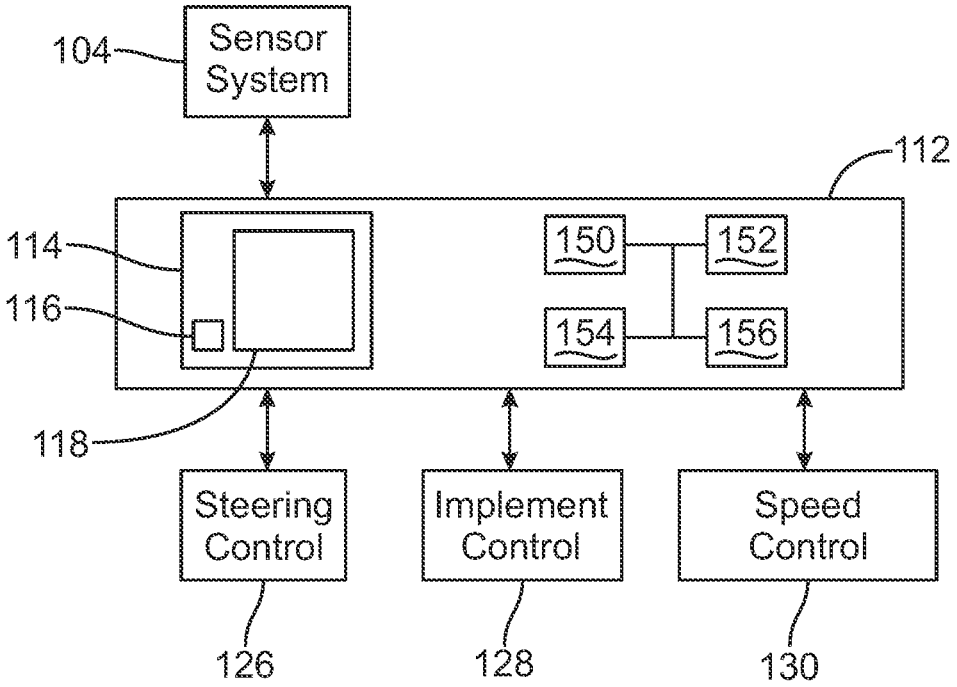
FIG. 2 is a block diagram representing an exemplary control system according to an embodiment of the present disclosure.

As schematically illustrated in FIG. 2, the self-propelled work vehicle 20 includes a control system including a controller 112. The controller 112 may be part of the machine control system of the work vehicle 20, or it may be a separate control module. The controller 112 may include a user interface 114 and optionally be mounted in the operator's cab 60 at the control station 62.

The controller 112 is configured to receive input signals from some or all of various sensors collectively defining a sensor system 104, individual examples of which may be described below. Various sensors in the sensor system 104 may typically be discrete in nature, but signals representative of more than one input parameter may be provided from the same sensor, and the sensor system 104 may further refer to signals provided from the machine control system.

The controller 112 may be configured to produce outputs, as further described below, to the user interface 114 for display to the human operator. For example, the controller 112 may be configured to communicate preferred positions of the work vehicle 20 and associated implements 42, 44, 46, 48 based on determined travel mode, slope of the terrain, and/or travelling direction. In the context of an excavator as the work vehicle 20, the preferred positions may relate to at least a position of the bucket 48 relative to the main frame, the ground surface, the travelling direction, or the like, in view of the various embodiments as further disclosed herein.

The controller 112 may further or in the alternative be configured to generate control signals for controlling the operation of respective actuators, or signals for indirect control via intermediate control units, associated with a machine steering control system 126, a machine implement control system 128, and an engine speed control system 130. The control systems 126, 128, 130 may be independent or otherwise integrated together or as part of a machine control unit in various manners as known in the art. The controller 112 may for example generate control signals for controlling the operation of various actuators, such as hydraulic motors or hydraulic piston-cylinder units (not shown), and electronic control signals from the controller 112 may actually be received by electro-hydraulic control valves associated with the actuators such that the electro-hydraulic control valves will control the flow of hydraulic fluid to and from the respective hydraulic actuators to control the actuation thereof in response to the control signal from the controller 112.

The controller 112 includes or may be associated with a processor 150, a computer readable medium 152, a communication unit 154, data storage 156 such as for example a database network, and the aforementioned user interface 114 or control panel 114 having a display 118. An input/output device 116, such as a keyboard, joystick or other user interface tool 116, is provided so that the human operator may input instructions to the controller. It is understood that the controller 112 described herein may be a single controller having some or all of the described functionality, or it may include multiple controllers wherein some or all of the described functionality is distributed among the multiple controllers.

Various operations, steps or algorithms as described in connection with the controller 112 can be embodied directly in hardware, in a computer program product such as a software module executed by the processor 150, or in a combination of the two. The computer program product can reside in RAM memory, flash memory, ROM memory, EPROM memory, EEPROM memory, registers, hard disk, a removable disk, or any other form of computer-readable medium 152 known in the art. An exemplary computer-readable medium 152 can be coupled to the processor 150 such that the processor 150 can read information from, and write information to, the memory/storage medium 152. In the alternative, the medium 152 can be integral to the processor 150. The processor 150 and the medium 152 can reside in an application specific integrated circuit (ASIC). The ASIC can reside in a user terminal. In the alternative, the processor 150 and the medium 152 can reside as discrete components in a user terminal.

The term "processor" 150 as used herein may refer to at least general-purpose or specific-purpose processing devices and/or logic as may be understood by one of skill in the art, including but not limited to a microprocessor, a microcontroller, a state machine, and the like. A processor 150 can also be implemented as a combination of computing devices, e.g., a combination of a DSP and a microprocessor, a plurality of microprocessors, one or more microprocessors in conjunction with a DSP core, or any other such configuration.

The communication unit 154 may support or provide communications between the controller 112 and external systems or devices, and/or support or provide communication interface with respect to internal components of the self-propelled work vehicle 20. The communications unit may include wireless communication system components (e.g., via cellular modem, WiFi, Bluetooth or the like) and/or may include one or more wired communications terminals such as universal serial bus ports.

The data storage 156 as further described below may, unless otherwise stated, generally encompass hardware such as volatile or non-volatile storage devices, drives, electronic memory, and optical or other storage media, as well as in certain embodiments one or more databases residing thereon.

Figure 3:
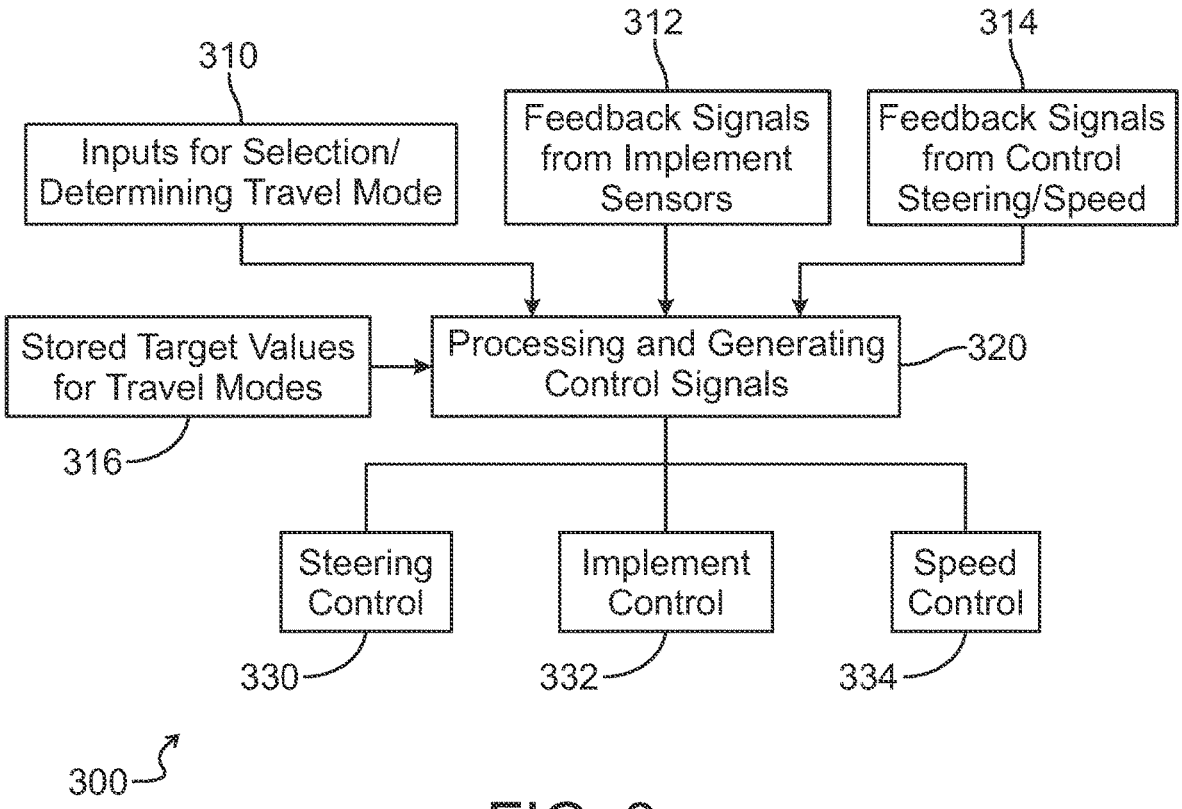
FIG. 3 is a flowchart representing an exemplary method according to an embodiment of the present disclosure.

Referring next to FIG. 3, an exemplary and high-level method 300 may now be described, followed by more particular examples of methods as disclosed herein and with further reference to FIGS. 4A-4E.

The method 300 may include receiving one or more inputs corresponding to a determined travel mode for the work vehicle 20 (step 310). Certain inputs may take the form of operator commands, via for example the user interface 114, regarding a configuration of terrain to be traversed, and in some embodiments may encompass manually/directly provided parameters and/or operations, sequences of parameters and/or operations, etc., as associated with the travel mode.

Exemplary such inputs may include travel command output signals corresponding to manual engagement of interface tools such as for example a pedal or joystick in the operator's cab 60.

Further exemplary such inputs may include direct selection of a travel mode to be implemented via a user interface tool 116 such as a sealed switch module (SSM), push button, touch screen, or equivalent device. In an embodiment, a plurality of predetermined travel modes may be graphically presented or otherwise individually selectable by the operator or equivalent user. The user interface 114 for travel mode selection may be provided in the operator's cab 60 or in certain embodiments may be remotely positioned relative to the work vehicle 20, for example a graphical interface generated on a mobile computing device or the like.

Still further exemplary such inputs may include output signals corresponding to an upcoming slope as detected via a 3D grade control system associated with the work vehicle 20. Such grade control systems may be configured to detect or otherwise predict changes in the slope of a terrain to be traversed by the work vehicle 20, using corresponding sensors such as imaging sensors, ultrasonic sensors, optical sensors, or the like, wherein the slope inputs may be obtained or otherwise selectively provided for algorithms as disclosed herein.

One or more implement sensor inputs (step 312) may be received as feedback signals from respective sources in the sensor system 104, such as for example from a kinematic detection system configured to monitor the current positions and/or operations of the element(s) (e.g., boom 44, arm 46, and/or bucket 48) in respective coordinate space, such as for example in an independent coordinate frame respective to a global navigation frame of the work vehicle 20. An exemplary kinematic system may include inertial measurement units (IMUs) mounted or affixed to elements of the boom assembly and/or main frame 32 of the work vehicle 20, and which further include a number of sensors including, but not limited to: accelerometers, which measure (among other things) velocity and acceleration; gyroscopes, which measure (among other things) angular velocity and angular acceleration; and/or magnetometers, which measure (among other things) strength and direction of a magnetic field.

The sensor system 104 may in certain embodiments optionally include sensors for implementing a counterweight balance feature to improve traction on steep grades, for example by measuring or determining load and/or traction of the ground engaging units 24 of the work vehicle 20 relative to the ground surface 38. Non-limiting examples may include load sensor, pressure sensor, and/or true ground speed sensor measurements for determining track slip, each being generally known to those of skill in the art.

In other embodiments, again without limitation of the scope of any disclosed invention herein unless otherwise specifically stated, the sensor system 104 may include one or more global positioning system (GPS) sensing units or an equivalent, integral with or otherwise independent of a grade control system and fixed relative to the main frame 32, which can detect an absolute position and orientation of the work vehicle 20 within an external reference system and can further detect changes in such position and orientation, and/or a camera based system which can observe surrounding structural features via image processing, and can respond to the orientation of the work vehicle 20 relative to those surrounding structural features.

Some or all of the preceding elements of a sensor system 104 may accordingly enable additional features that may be contemplated within the scope of a system as disclosed herein. For example, an operator of a self-propelled work vehicle 20 must sometimes manage a vertical position of an implement such as the bucket 48, or a downward pressure exerted thereby, to keep the tracks 24 engaged with the ground 38 for proper traction. The controller 112 may be configured to estimate down-force on the bucket 48 as a way to avoid excessive lifting of one end of the work vehicle, optionally utilizing sensor inputs as previously noted such as pressure values, track slip estimates (via a ground speed reference like GPS, camera, etc.) or the like. Alternatively, different operator inputs (e.g., boom commands) may be programmatically interpreted as vertical commands, further allowing the operator to adjust a downward force while automating the horizontal motion.

Still another example of features enabled by sensor system 104 inputs and associated controller 112 programming may include a tip-over warning feature, indicating when the work vehicle 20 is approaching an unsafe position or orientation, and in some embodiments indicating recommended mitigation actions, e.g., where to position the bucket 48 under the detected circumstances. In such an example, the work vehicle 20 may be configured to monitor slope and calculate the ideal pose as previously noted, but instead of automatically acting it may put bounds on that pose and slope and generate a warning output to the operator when those bounds are exceeded, and/or indicate to the operator a suggested action.

One or more steering control and/or speed control inputs (step 314) may also be received as feedback regarding travel commands from respective sources in the sensor system 104, and further processed along with the implement sensor inputs and travel mode inputs (step 320). In such embodiments control operations may accordingly be executed responsive to one or more of a determined (e.g., selected) travel mode, feedback signals corresponding to respective current positions and/or operations of the implements (e.g., boom 44, arm 46, and/or bucket 48 individually or collectively as a boom assembly 42), and the aforementioned feedback signals corresponding to travel commands.

Such processing, which may be carried out by the controller 112 as previously referenced, may further include stored target values 316 for each of one or more elements of the work vehicle 20 (e.g., boom assembly, steering, vehicle speed) in accordance with the selected or determined travel mode. The stored target values may be retrievable by the controller 112 from associated data storage 156 in view of a determined travel mode, and further may comprise for example respective predetermined target positions and/or operations of each relevant work implement or element thereof (e.g., relative positions and/or or movements of the excavator boom 44, arm 46, bucket 48, etc.).

Control signals may then be generated (step 320) regarding one or more parameters or operations (or sequences of parameters or operations) for automation in conjunction with the selected or determined travel mode, and may be provided to any one or more of the steering control system 126 (step 330), the implement control system 128 (step 332), and the engine speed control system 130 (step 334) depending on the relevant application. The control signals, and the relevant control systems for which automation is selectively utilized, may be dependent on any or all of various conditions including for example a determined travel mode, a grade/slope of the terrain across which the work vehicle travels, an angle at which the work vehicle travels up or down a sloped terrain, a load carried by the work vehicle, a condition of the ground surface, etc.

Various exemplary travel modes and corresponding implement positions, operations, and/or sequences of operations may be further described by reference to FIGS. 4A to 4E, and further for illustrative purposes with respect to an excavator as shown in FIG. 1 as the work vehicle 20.

Figure 4A:
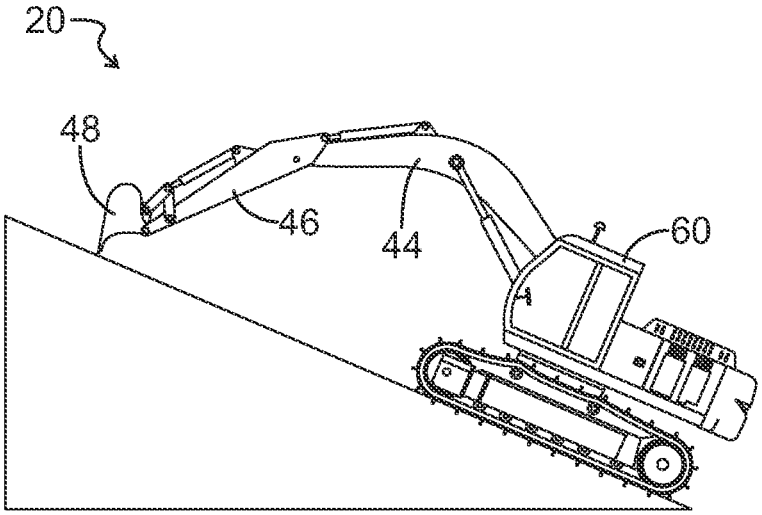
FIGS. 4A-4E are side views representing the excavator of FIG. 1 with relevant work implements/attachments positioned in accordance with various exemplary travel modes and in view of a method as disclosed herein.

In a first travel mode as represented in FIG. 4A, system inputs have been provided from an operator or an automated output from a 3D grade control system to indicate that a steep uphill slope is to be (or is being) traversed by the work vehicle 20. Although in certain embodiments an initial positioning of the boom assembly 42 may be automated, the operator may generally be required to initially position the boom assembly 42 so as for example to fix the teeth of the bucket 48 in the ground surface 38. The work vehicle 20 may further be oriented such that the traveling direction of the work vehicle is defined from the idler 52 toward its respective drive sprocket 54. Such positioning may for example enable the bucket 48 to be used as a tool to pull the excavator 20 as it travels uphill and adds stability to the operation. Upon initial positioning of the bucket 48 the operator may select an appropriate travel command, which may for example include a work vehicle speed, and the system generates arm retraction commands in accordance with the rate of the travel command.

For extended or repeated periods of uphill operation, it may be contemplated that the operator will need to stop the work vehicle 20 and extend the boom assembly 42 to re-position the teeth of the bucket 48 in the ground surface 38 several times, i.e., every time the excavator 20 approaches the bucket 48 as it travels uphill.

It may further be contemplated and accordingly programmed in the controller 112 that the work vehicle 20 is directed to stop during at least one required operation of the boom 44, arm 46, and/or bucket 48 during a determined travel mode, and to move forward only while the respective implement 42, 44, 46, 48 is maintained in a predetermined position during the determined travel mode.

Figure 4B:
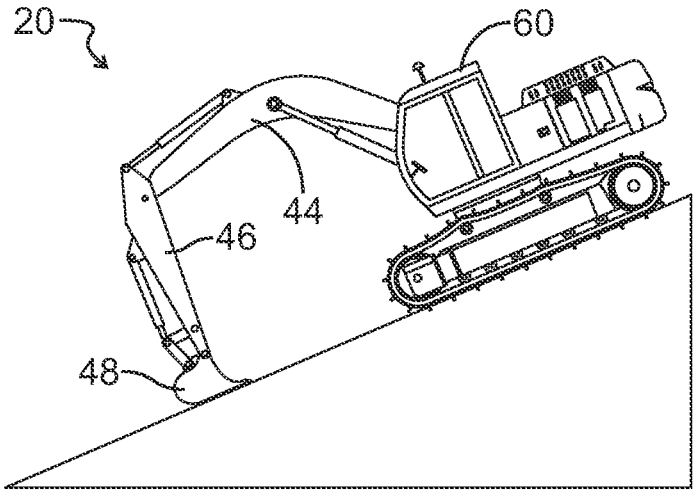

In a second travel mode as represented in FIG. 4B, system inputs have been provided from an operator or an automated output from a 3D grade control system to indicate that a steep downhill slope is to be (or is being) traversed by the work vehicle 20. Although in certain embodiments an initial positioning of the boom assembly 42 may be automated, the operator may generally be required to initially position the boom assembly 42 so as for example to place the bucket 48 in parallel with the ground surface 38. Such positioning may for example enable the bucket 48 to provide drag as the excavator 20 travels downhill and adds stability to the operation. Upon initial positioning of the bucket 48 the operator may select an appropriate travel command, which may for example include a work vehicle speed, and the system generates commands to lift the boom 44 and retract the arm 46 in accordance with the rate of the travel command.

For extended or repeated periods of downhill operation, it may be contemplated that once the excavator is properly positioned on the slope, it may utilize the drag generated by the parallel bucket position for stable movement throughout the duration.

Figure 4C:
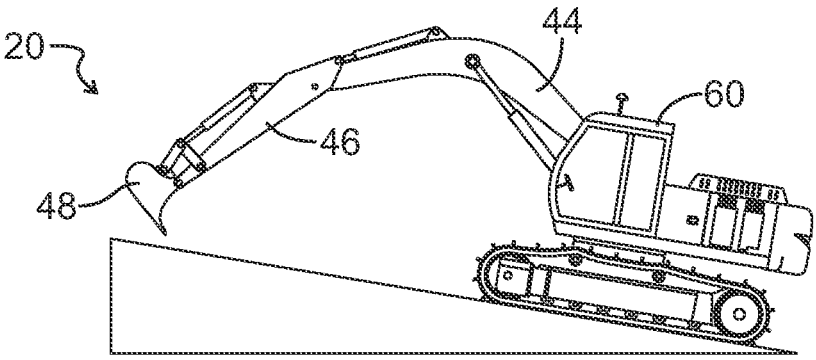

In a third travel mode as represented in FIG. 4C, system inputs have been provided from an operator or an automated output from a 3D grade control system to indicate that a moderate uphill slope is to be (or is being) traversed by the work vehicle 20. In accordance with initiation of this travel mode, the system may generate commands to automatically extend the bucket 48 forward with the teeth (distal edge) curled out and facing the ground surface 38 (e.g., about half a meter above the ground surface) using kinematic feedback. The work vehicle 20 may further be oriented such that the traveling direction 58 of the work vehicle 20 is defined from the idler 52 toward its respective drive sprocket 54. Such positioning may preferably minimize or otherwise maintain a low center of gravity for the work vehicle 20, improving stability accordingly. In an embodiment, when the travel mode is first entered the system may initially generate a stop command (i.e., zero forward movement) for the work vehicle 20 until some or all of the implements (e.g., boom 44, arm 46, bucket 48, etc.) are moved to their respectively specified positions.

Figure 4D:
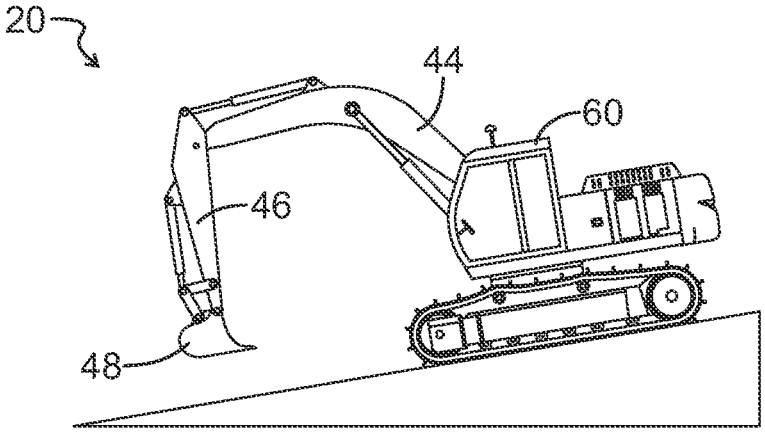

In a fourth travel mode as represented in FIG. 4D, system inputs have been provided from an operator or an automated output from a 3D grade control system to indicate that a moderate downhill slope is to be (or is being) traversed by the work vehicle 20. In accordance with initiation of this travel mode, the system may generate commands to automatically move the arm 46 to a position perpendicular to the ground surface 38 and to automatically move the bucket 48 to a position parallel to the ground surface 38. In an embodiment, when the travel mode is first entered the system may initially generate a stop command (i.e., zero forward movement) for the work vehicle 20 until some or all of the implements (e.g., boom 44, arm 46, bucket 48, etc.) are moved to their respectively specified positions.

Figure 4E:
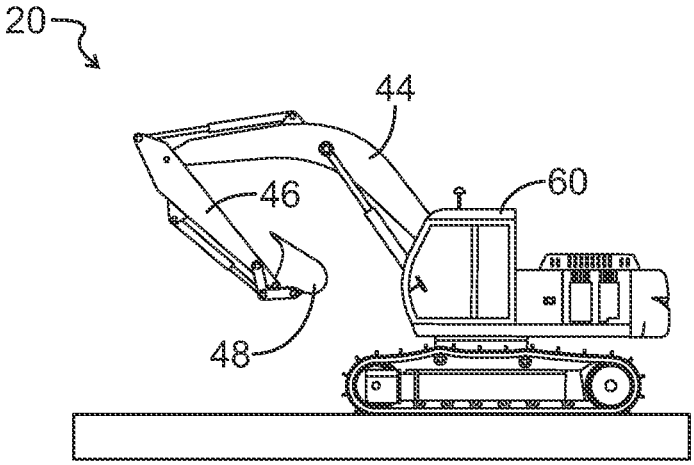

In a fifth travel mode as represented in FIG. 4E, system inputs have been provided from an operator or an automated output from a 3D grade control system to indicate that a relatively flat (~zero slope) portion of terrain is to be (or is being) traversed by the work vehicle 20. In accordance with this travel mode, the system may generate commands to automatically move the boom 44, arm 46, and bucket 48 elements to recommended or predetermined positions before travel. In an embodiment, when the travel mode is first entered the system may initially generate a stop command (i.e., zero forward movement) for the work vehicle 20 until some or all of the implements (e.g., boom 44, arm 46, bucket 48, etc.) are moved to their respectively specified positions.

In some embodiments, the positions or operations for a given implement or collection of implements 42, 44, 46, 48 may be determined not only in view of a travel mode but further taking into account other conditions such as for example a work state and/or load. For example, inputs from a payload weighing system associated with the work vehicle 20 may influence how the various implement elements can be safely positioned for a given slope or degree thereof. In association with a given travel mode, the positions and/or operations of various implements 42, 44, 46, 48 may be further dependent on work vehicle travel commands (forward movement and/or steering) as well as ground surface conditions, wherein a bucket 48 may for example be positioned and thereby utilized to help stabilize the main frame 32 of the work vehicle 20 during turning movements of the ground engaging units 24 on a sloped ground surface 38, etc.

The user interface 114 as disclosed herein may be configured for enabling or overriding the automated control functions via any manual hydraulic command, such as via a button or equivalent on/off actuator. Alternatively, such an override may be implemented by the operator simply carrying out the functions manually according to the conventional techniques, such as for example manual boom 44, arm 46, or bucket 48 commands using the relevant joysticks. In various embodiments, manual interaction by the operator may not disable or interrupt the automated controls for a determined travel mode, but rather take the form of travel commands as further (e.g., additive) inputs to the controller for augmenting and/or modifying the associated control signals. The operator may accordingly adjust the motion of the work vehicle 20 without explicitly interrupting an overall automated coordination with the ground engaging units 24.

In a particular embodiment, the user interface 114 may include tools corresponding to a selective disable (automation off) feature, a selective enable (automation on) feature, and an indication feature wherein the controller 112 provides signals to indicate and/or recommend positions and/or operations of the work vehicle 20 and associated implements 42, 44, 46, 48 based on the travel mode. For example, it may be desirable to restrict automation features to steep slopes or other treacherous conditions of the ground surface, whereas only visual and/or audible indications may be sufficient for travel modes associated with flat ground surfaces or ground surfaces having a moderate slope and otherwise normal operating conditions.

As used herein, the phrase "one or more of," when used with a list of items, means that different combinations of one or more of the items may be used and only one of each item in the list may be needed. For example, "one or more of"

item A, item B, and item C may include, for example, without limitation, item A or item A and item B. This example also may include item A, item B, and item C, or item B and item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of stability control for a self-propelled work vehicle comprising a plurality of ground engaging units and at least one work implement, wherein the at least one work implement comprises a boom assembly having a first end pivotally coupled to a main frame of the work vehicle and a working tool at a second end configured for controllably working terrain, the method comprising:

receiving first feedback signals from one or more sensors, the first feedback signals corresponding to respective current positions and/or operations of the at least one implement;

determining a travel mode as corresponding to a predicted work vehicle grade based on second feedback signals from one or more further sensors, wherein the one or more further sensors comprising at least one of imaging sensors, ultrasonic sensors, and/or optical sensors, and wherein the second feedback signals correspond to sensed terrain features in a traveling direction for the work vehicle;

retrieving from data storage at least respective predetermined target positions of the working tool and associated operations of the at least one work implement, corresponding to the determined travel mode for the self-propelled work vehicle; and generating one or more control signals for automatically controlling the at least one work implement to the respective predetermined target positions and through the respective operations, responsive to at least the received first feedback signals.

2. The method of claim 1, wherein the determined travel mode corresponds to a direction and/or amount of slope for terrain upon which the work vehicle travels.

3. The method of claim 1, further comprising enabling manual dismissal of the automatic control during the determined travel mode via a user interface.

4. The method of claim 3, wherein the travel mode is determined in accordance with manual user selection from among a plurality of travel modes via the user interface.

5. The method of claim 1, further comprising receiving feedback signals corresponding to travel direction and/or speed commands for the self-propelled work vehicle during the determined travel mode.

6. The method of claim 5, further comprising:

generating the one or more control signals for controlling the at least one work implement to the respective predetermined target positions and/or through the respective operations, responsive to the determined travel mode, the received first feedback signals corresponding to respective current positions and operations of the at least one implement, and the received feedback signals corresponding to the travel direction and/or speed commands.

7. The method of claim 5, further comprising:

generating one or more control signals for controlling the work vehicle speed during the determined travel mode, responsive to at least the predetermined target positions and operations of the at least one work implement and the received first feedback signals corresponding to respective current positions and operations of the at least one implement.

8. The method of claim 7, wherein the work vehicle is directed to stop during at least one required operation of the at least one implement during a determined travel mode, and to move forward only while the at least one implement is maintained in a predetermined position during the determined travel mode.

9. A self-propelled work vehicle comprising:

a plurality of ground engaging units supporting a vehicle chassis;

at least one work implement, wherein the at least one work implement comprises a boom assembly having a first end supported by and pivotally coupled to the vehicle chassis and a working tool at a second end configured for controllably working terrain;

one or more sensors configured to provide first feedback signals corresponding to respective current positions and/or operations of the at least one implement;

one or more further sensors configured to provide second feedback signals corresponding to sensed terrain features in a traveling direction for the work vehicle, wherein the one or more further sensors comprise at least one of imaging sensors, ultrasonic sensors, and/or optical sensors;

data storage having stored therein at least respective predetermined target positions of the working tool and associated operations of the at least one work implement corresponding to each of a plurality of travel modes for the self-propelled work vehicle, the travel modes corresponding to a predicted work vehicle grade, responsive to at least the received second feedback signals; and a controller configured, for a determined travel mode, to generate one or more control signals for automatically controlling the at least one work implement to the respective predetermined target positions and through the respective operations, responsive to at least the received first feedback signals.

10. The self-propelled work vehicle of claim 9, wherein the controller is further configured to receive feedback signals corresponding to travel direction and/or speed commands for the self-propelled work vehicle during the determined travel mode.

11. The self-propelled work vehicle of claim 10, wherein the controller is further configured to generate the one or more control signals for controlling the at least one work implement to the respective predetermined target positions and/or through the respective operations, responsive to the determined travel mode, the received first feedback signals corresponding to respective current positions and operations of the at least one implement, and the received feedback signals corresponding to the travel direction and/or speed commands.

12. The self-propelled work vehicle of claim 10, wherein the controller is further configured to generate the one or more control signals for controlling the work vehicle speed during the determined travel mode, responsive to at least the predetermined target positions and/or operations of the at least one work implement and the received first feedback signals corresponding to respective current positions and operations of the at least one implement.

13. The self-propelled work vehicle of claim 12, wherein the work vehicle is directed to stop during at least one required operation of the at least one implement during a determined travel mode, and to move forward only while the at least one implement is maintained in a predetermined position during the determined travel mode.

14. The self-propelled work vehicle of claim 9, wherein manual dismissal of the automatic control is enabled during the determined travel mode via a user interface.

15. The self-propelled work vehicle of claim 14, wherein the travel mode is determined in accordance with manual user selection from among a plurality of travel modes via the user interface.

16. The self-propelled work vehicle of claim 9, wherein the determined travel mode corresponds to a direction and/or amount of slope for terrain upon which the work vehicle travels.

17. The self-propelled work vehicle of claim 9, wherein the controller is further configured to automatically determine the travel mode based on feedback signals corresponding to a predicted work vehicle grade.

* * * * *